United States Patent [19]

Krause

[11] Patent Number: 4,756,327

[45] Date of Patent: Jul. 12, 1988

[54] IRRIGATION HEAD CONTROL DEVICE AND METHOD

[76] Inventor: Robert D. Krause, Rte. 1 Box 1754, Fruitland, Id. 83619

[21] Appl. No.: 42,858

[22] Filed: Apr. 27, 1987

[51] Int. Cl.[4] ..... F17D 1/08

[52] U.S. Cl. ..... 137/14; 137/236.1; 137/573; 137/593

[58] Field of Search ..... 137/573, 574, 14, 236.1, 137/593; 251/127

[56] References Cited

U.S. PATENT DOCUMENTS

| | | | |
|---|---|---|---|
| Re. 14,081 | 3/1916 | Linxweiler | 114/165 |
| 172,877 | 2/1876 | Hays | 251/127 |
| 1,120,351 | 12/1914 | Weston | 137/573 |
| 2,012,495 | 8/1935 | Bradbeer | 137/593 |
| 2,124,619 | 7/1938 | Kerr | 137/593 |
| 3,159,172 | 12/1964 | Baxter | 137/236.1 |
| 3,690,115 | 9/1972 | Clayton | 137/14 |

*Primary Examiner*—A. Michael Chambers

*Attorney, Agent, or Firm*—Nicholas T. Bokides

[57] ABSTRACT

A method and apparatus for head control of irrigation waters in above-ground gated pipe located on a gradient. The method includes the steps of: measuring the elevation drop over the length of said pipe; providing an in-line container at predetermined elevation drops along said pipe, said container having an inlet for receiving water from the upstream portion of said pipe and an outlet for discharging water to the downstream portion of said pipe; dividing each of said containers with a height adjustable partisan located between said intake and said outtake; and adjusting the height of each of said height adjustable partisan to provide the desired flow from the openings in the pipe upstream of said partisan being adjusted.

5 Claims, 2 Drawing Sheets

IRRIGATION HEAD CONTROL DEVICE AND METHOD

BACKGROUND OF THE INVENTION

1. Field of the Invention

The present invention relates to free-flowing, unpressurized irrigation systems such as corrugated row crop fields, flood irrigation and like systems, and more particularly, to an apparatus and method for providing an equal distribution of water from gated pipe over a field having a gradient.

2. Description of the Prior Art

The prior art discloses numerous systems for the irrigation of agricultural products. These systems can generally be divided into two classifications: those that rely on a high-pressure source for uniform distribution of water, such as sprinklers of various configurations and types; and those that rely on gravity for the uniform distribution of water over a field, such as ditches, flood irrigation and gated pipe. The present invention relates to irrigation systems of the latter type wherein gravity distribution is desired.

A substantial portion of the irrigated farm ground in the United States derives its water supply from centralized community, local or governmental water projects. Each of such projects typically deliver water by gravity flow through a series of open ditches from the central project to the various agricultural lands served by the project. Many systems have been in place for decades and the agricultural lands receiving such waters have had a substantial period of experience to develop methods of distributing the water from the gravity flow open ditch system to the particular cropland concerned.

One of the variables which farmers relying on the above gravity flow systems for irrigation have had to contend with is the variation in flow of water to each particular agricultural property. Typically there are numerous upstream water users to any particular agricultural property. Although control of the flow to each property may be regulated through some third party such as a water master who attempts to maintain the appropriate flow to each user, each agricultural user acts relatively independently in determining the amount of water to be used at any particular time. This can result in a great variation in the flow to any downstream user.

To minimize the fluctuation in water flows and levels, and also to provide water to the largest number of acres possible from the particular project, users are generally required to rotate their irrigation waters throughout each parcel of property. Allocation of water is, therefore, generally premised on 24-hour use by each user and it may take a particular user between and 5 and 14 days to provide water to all portions of any particular parcel. Rotation may be done on a daily basis or on a 12-hour basis or on such other periodic basis as the user determines is best for the particular crop involved. Such rotation will continue throughout the irrigation season.

As is well appreciated by those skilled in the art, any irrigation system using gravity-supplied waters must be capable of metering precise amounts of water to the cropland despite the potential of substantial fluctuations in flow and level of water delivered to the user due to the activities of upstream and downstream users beyond any particular users' control. One system which has gained widespread acceptance for the irrigation of high-quality farm ground is the use of siphon tubes. Each field is worked to provide a relatively flat service with a gradient from the top of the field to the bottom of the field. A ditch is then placed along the top of the field which waters from the central system are diverted into. Small siphon tubes are then set from the ditch at the top of the field to small "corrugations" or ditches which run between rows of crops. One particular field may have 100 or more corrugations, each which must receive water on a periodic basis for irrigation of the crop. The farmer will typically set a number of siphon tubes and than on a periodic basis, remove such tubes and reset them to provide water to different corrugations, continuing such procedure until the complete field is irrigated.

The advantage of the siphon tube method is that variations in the flow and height of head ditch will provide a minimum fluctuation in the water metered through the siphon tubes. The diameter of the siphon tube will largely determine the flow of water into the corrugation. Another advantage of the siphon tube method is that the flow from the siphon tubes is at a very low pressure and thereby minimizes erosion of the corrugates and adjacent planted rows. A further advantage of the overall system is that it does not require the high capital investment of pressurized systems such as pumps, underground pipes and above-ground sprinkler systems, all of which have a relatively limited useful life. Corrugated irrigation techniques from open ditch delivery systems have been in use for decades and still enjoy widespread use.

The disadvantage to the siphon tube distribution method is that it is relatively labor intensive and also results in high water losses through evaporation and soil losses. Although soil losses with siphon tube distribution systems can be greatly mitigated through the use of concrete ditches, such ditches are costly to construct and maintain. Any cracks must be immediately repaired or they may result in washing out of the soil supporting the ditch and depositing large amounts of moisture under the ditch with attendant heaving and further cracking during winter freezes.

As is well appreciated in the art, a greater emphasis is continuously being placed on conservation of water. This emphasis is due to a number of factors including increased demand for limited supplies. It is only natural that due to such emphasis greater consideration would be given to methods of eliminating open ditches and attendant evaporation and high soil losses. It is also noteworthy that soil losses may vary considerably depending on the type of soil concerned. In some areas, soil losses can be so high as to make open ditches totally impractical. In other areas soil losses may be deemed acceptable by the end user. In all geographical areas and soil conditions it is believed that continued conservation efforts will be required to maximize the use of a limited water supply.

One method minimizing such losses, at a substantially reduced cost over concrete ditches, which has recently gained greater and greater acceptance is the use of gated pipe in place of the open ditch and siphon tubes. Gated pipe consists of pipe having a diameter of between 6" and 12" with a number of adjustable openings on the side to allow the flow of water from the pipe to the farmland. Although examples of gated pipe are illustrated in the prior art as early as 1914 (see U.S. Pat. No. Re. 14,081), such pipe has only recently gained commercial acceptance due to the convenience with which it can be used and the high efficiency of use compared to open ditches. Another important factor in the increased use of gated pipe is that it is compatible with the gravity flow systems which are and have been in existence for decades.

To convert an existing ditch and siphon tube system to dated pipe is relatively simple. As indicated above, water is typically delivered to the agricultural land in open ditches through gravity flow. Instead of directing said water into ditches adjoining the field and withdrawing the water with numerous siphon tubes, the water is instead channeled into gated pipe running along the boarder of the field to be irrigated. The various openings on the gated pipe are placed in registry with the corrugated rows of the field to be irrigated and the openings can then be adjusted for flow.

As is well appreciated and as indicated in U.S. Pat. No. Re. 14,081, page 1, lines 98–102, it is desired that the water flow from gated pipe be at minimum pressure in a steady stream to minimize erosion and to obtain a uniform flow.

Although gated pipe has recently gained greater and greater commercial acceptance, there are certain inherent difficulties which have slowed such acceptance. Due to the fact that once water is channeled into the gated pipe it encounters a closed system, the particular gradient upon which the gated pipe is placed has a substantial effect on the flow of water from the openings. For example, if the gated pipe is placed along a substantial gradient, it would tend to cause water at the lower end to have a greater pressure requiring narrowing the openings to provide a smaller but more forceful stream for an equivalent flow to the upper free flowing end of the pipe. Although it is possible to make such adjustments, it is difficult visually to provide equal flows where the lower end consists of a strong, spray-like stream and the upper end consists of a steady, low-pressure flow. Much of the irrigation work is also done by inexperienced field hands and instruments are not typically available to measure flow such that visual adjustments are the rule. If high pressure is encountered at the lower end of the pipe, the strong stream which results is also detrimental in that it causes erosion of the field and crop.

Various methods have been attempted to solve these problems. The flow of water into the pipe may be restricted such that the flow from the upper end reduces the water level sufficiently that minimum pressure results at the lower end. Attempts have also been made to put valves at various spacings along the pipe to control the flow through the gated pipe such that equal quantities of water will be dispersed from the upper end as the lower end.

In a steady state system, through such valves and precise adjustment to the gates, equal flows may be achieved, although it does require substantial experimentation and adjustments to achieve equal flow throughout the pipe on a gradient. As is well appreciated in the art and as indicated above, the typical user does not encounter a steady state system. There may be increased levels and flows to the end user or decreased flows. Therefore, even once an acceptable steady state system is achieved, upon the farmer going home and leaving the system over night, changes in the volume of water supplied to the user due to third-party practices, are beyond the users control and may result in the system being thrown out of balance resulting in uneven irrigation to the field.

Another problem encountered in the use of valves to control the flow in gated pipe is the substantial waste water and trash encountered by many users in their irrigation water. This results in part from the fact that downstream users almost assuredly are receiving water which to a large degree has been already circulated through fields by one or more upstream users. It is calculated that the water received by many users has already been used between three and six times before it is returned to the river or final waste ditch. Even extremely small amounts of trash can result in the partial plugging of gates throwing such systems out of balance.

Another substantial disadvantage to the use of valves in metering flow from gated pipe is the difficulty encountered should adjustments to the flow be later desired. For example, once the user goes through the various steps to adjust the flow correctly over the complete length of the gated pipe for existing conditions, should the user decide that additional flow is desired from the upper portion of the pipe it would require readjustment of the various valves and numerous gates. Likewise, upon each rotation of water, the complete balancing of the system would again be required. As is well appreciated by those skilled in the art, in a closed system, every significant change in flow from an upstream gate will reduce the water available downstream and require readjustment of the system. Even under ideal conditions, the balancing of a system of gated pipe through the use of valves is a time consuming operation which requires numerous adjustments of the various gates and valves on a trial and error basis as each adjustment effects the other adjustments.

It is a principal object of the present invention to provide a method and apparatus to allow easy and convenient adjustment of the flow of water from gated pipe which is relatively impervious to changes in the volume of water supplied and the trash typically encountered.

It is a further object of the present invention to make the use of gated pipe much more convenient and commercially acceptable.

It is a further object of the present invention to provide the minimum head desired with gated pipe throughout the length of the pipe despite substantial gradients and variations in flow.

It is the further object of the present invention to allow farmers great flexibility in irrigation rotation such that water from a single length of gated pipe may be drawn from the upper and lower ends simultaneously with substantially equal flows and low pressure, and rotation to other portions of the pipe can be made without further adjustments.

It is the further object of the present invention to eliminate the need for precise control of the flow of water into gated pipe from the open gravity ditches.

It is another object of the present invention to eliminate the need for the precise adjustment of various valves in gated pipe.

SUMMARY OF THE INVENTION

The present invention relates to a method and apparatus which greatly enhances the ability to conveniently control the head in gated pipe over substantial gradients and flow variations. In its broadest aspect, the present invention contemplates providing a series of containers or chambers at predetermined elevations along the gated pipe, each of said containers to have an intake for the receipt of water from the upstream pipe and an outtake for the discharge of water to the downstream pipe with an adjustable height partition between the intake and outtake. Such containers may be open to the atmosphere, and it has been found that by adjusting the height of the partition to obtain an appropriate flow from the gates on the upstream pipe, fluctuations in the volume of water received by the pipe minimally effect flows. In the preferred embodiment, the lower end of the gated pipe would also be provided with such a container with the outtake connected to the waste or return ditch to place any water discharged back into the system.

It has been found that by placing such containers at predetermined elevations along the gated pipe, each adjustable height partition may be adjusted such that the upstream pipe receives an appropriate flow of water through it openings. Once such adjustment is made, the user is not required to make further adjustments to the system and can merely be concerned with rotating the water used through opening and closing of the adjustable gates along the length of the pipe. It has also been found that once such adjustment with the partitions is made, the user has a great flexibility in determining which portions of the field to irrigate. For example, the user may irrigate from the upper end of the pipe and the lower end of the pipe simultaneously with constant flows from the various gates then, without further adjustments, irrigate from a different portion of the pipe.

The preferred embodiment of the invention incorporates a second partition between the adjustable height partition and the outlet which partition extends downwardly from above the outlet to below the outlet and provides what is herein termed an "air chamber" between the outlet and the second partition. This air chamber provides for the release of any air trapped by the water such that the air is eliminated from the pipe and does not disrupt the flow from the various gates, thereby further enhancing a steady flow from each opening in the pipe.

In most applications it is also preferable to provide the container or chamber with an adjustable opening similar to that in the gated pipe. This opening should be located between the intake and the upwardly extending partition such that a flow of water can be directed from the chamber to the field to be irrigated in a direction perpendicular to the pipe. Such an opening provides an additional source of irrigation water at a location which otherwise would be missed do to the addition of the apparatus described herein to the gated pipe system.

DESCRIPTION OF THE DRAWINGS

Further features and advantages of the invention will be apparent from the following description and drawings in which.

DETAILED DESCRIPTION OF PREFERRED EMBODIMENT

Figure 1:
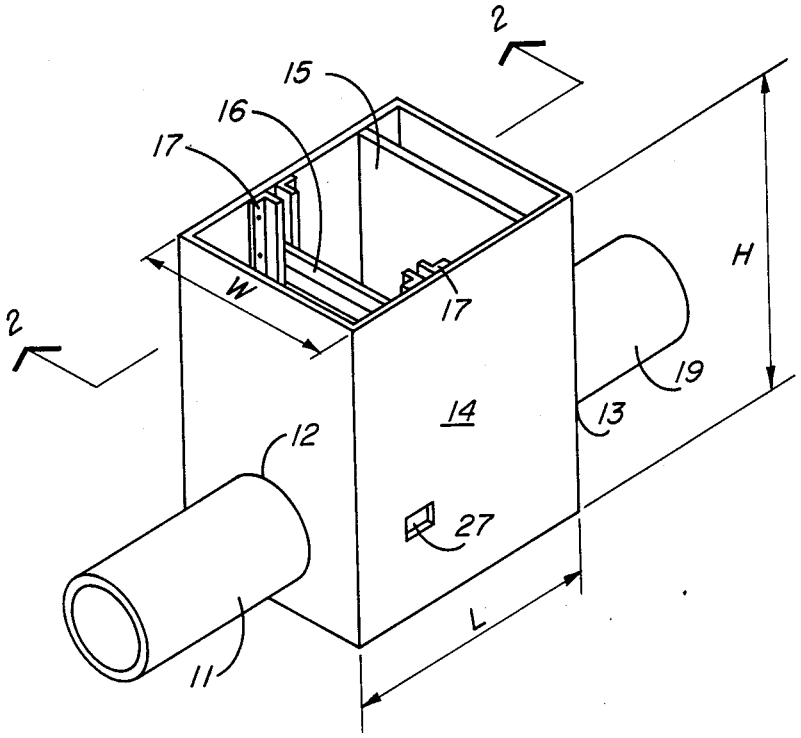
FIG. 1 is an isometric view of a preferred embodiment of one of the containers positioned in a gated pipe system.

FIG. 1 illustrates an overall view of a preferred embodiment of the container which is the subject of this invention. The container 14, has a width of W, a height of H, and a length of L, and an intake 12 and an outtake 13. A coupler 11, is connected to intake 12 for receiving sections of gated pipe from upstream, and coupler 19, is connected to outtake 13, for receiving downstream sections of gated pipe.

Container 14 includes an upwardly extending partition 16 which, in the preferred embodiment, is held by slide rails 17. Preferably, upward extending partition 16 is adjustable by providing additional sections of the partition to slide in rails 17 so different heights of the partition may be achieved. The container further includes a downwardly extending partition 15 which, as will be seen, extends below the uppermost portion of outtake 13. An adjustable opening 27 is placed in the side of the container between intake 12 and upwardly extending partition 16, below the top of said upwardly extending partition.

Figure 2:
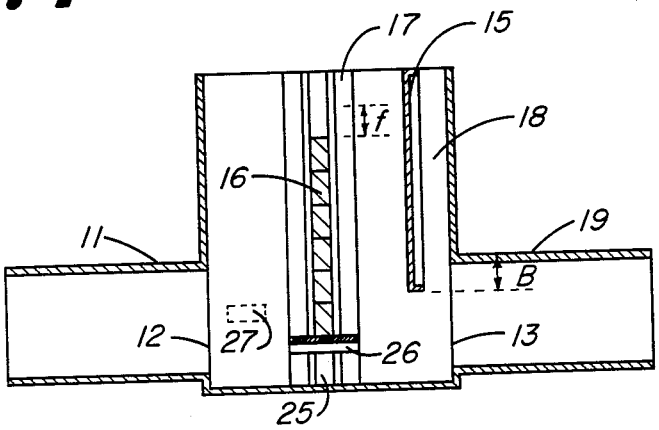
FIG. 2 is a cross-sectional view of the container illustrated in FIG. 1.

Referring to FIG. 2, a cross-sectional side view of the container of FIG. 1 is illustrated. As shown in FIG. 2, downwardly extending partition 15 extends a distance of B below the uppermost portion of outtake 13. Added features of the preferred embodiment not illustrated in FIG. 1 include stop 26 and limited opening 25.

Figure 3:
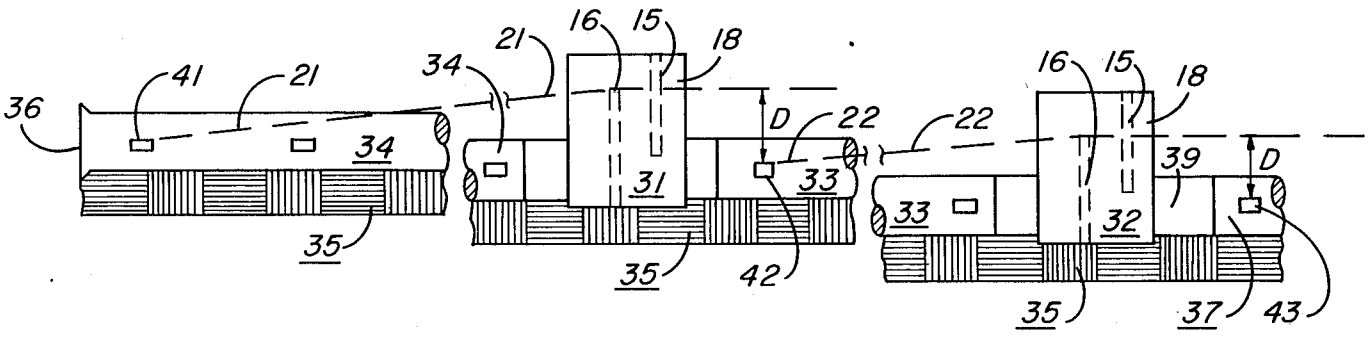
FIG. 3 is a cross-sectional view of a portion of a gated pipe system having two containers separated by a section of gated pipe in an above-ground irrigation system.

Referring to FIG. 3, a portion of a gated pipe system is shown having intake 36 in gated pipe section 34 which is connected to container 31. Container 31 is connected to container 32 through gated pipe section 33. The gated pipe system is on ground surface 35. Each of the containers have an upwardly extending partition 16; a downwardly extending partition 18; and an air chamber 18, which is formed by downwardly extending partition 15. Depending on the size of the field and gradients, the complete gated pipe system may have additional containers and/or sections of gated pipe. Water is conducted into intake 36 from the open ditch system or from prior gated pipe sections. Excess water is discharged from outtake 39 in container 32 to a waste water ditch or to downstream gated pipe 37 and to additional containers and gated pipe sections comprising the remaining portion of the system for the field subject to irrigation.

Dashed lines 21 and 22 indicate constant elevations. As can be seen by reference to dashed line 21, water flows from intake 36 to container 31 through gated pipe section 34 as the ground surface slopes downward from intake 36 to container 31. Likewise, as can be seen by reference to dashed line 22, water will flow from container 31, through gated pipe 33, to container 32.

The method of the present invention is best illustrated by reference to FIG. 3. The first step in utilizing the present method requires determining the elevation drop over the field. Once such a determination is made, containers—are placed at predetermined elevation drops along the field. The preferred elevation drop is depicted in FIG. 3 as the distance D which is the elevation drop between gate 41 in gated pipe section 34 and gate 42 in gated pipe section 33. Likewise, D′ is the elevation drop between gate 42 in gated pipe section 33 and gate 43 in gated pipe section 37. To minimize costs and keep the number of containers to a minimum, preferably D and D′ are the same or within 20% to 30% of each other, however, for proper working of the subject invention, each of the dimensions D and D′ must be less than an empirically determined maximum elevation drop. As long as the elevation drop between containers is below the determined maximum, the system will function properly.

Initially assuming that intake 36 is located at the edge of the field to be irrigated and the field extends toward container 31, water is introduced from an open ditch system into intake 36. Once a flow of water is achieved through the gated pipe 34 and into container 31, partition 16 on container 31 is height adjusted to provide the proper flow of water from opening 41 in gated pipe 34. Each of the gates may then be adjusted for appropriate flow with the assurance that variations in water level will have a minimal effect on their flow thereafter, assuming such variations do not reduce the flow below the level necessary to irrigate and do not increase the flow beyond the capacity of the system.

Water flowing over partition 16 in container 31 is discharged into gated pipe section 33 and flows to container 32. Again, partition 16 in container 32 is height adjusted to achieve the desired flow of water from gated opening 42 in gated pipe 33. Each of the gates in pipe 33 may then be adjusted accordingly with the assurance that variations in system flow will have minimum effect on the water discharged for each of said gates.

Assuming outtake 39 is connected to additional sections of gated pipe with additional containers, the user would then go to the next downstream container and again adjust the upwardly extending partition in such container to provide an appropriate flow from the gated pipe opening immediately adjacent to container 32, i.e. gate 43. This process would continue downstream until all partitions in each container were adjusted to the proper height to provide an adequate flow from the most upstream gate in the immediate upstream pipe. Unlike a valve system of flow control, there is no need to, by trial and error, go back to upstream containers to readjust them based on the downstream flow. Due to the limited water supply generally available and the rotation generally required in irrigating crops, it is understood that it may be several days before a user would go through the process of adjustment on the first irrigation rotation of the season. It would of course be necessary to close the gated pipe openings on some sections of the pipe before additional sections could be used for irrigation due to such limited water supply. The advantage to the method is that once the rotation is completed and all partitions are adjusted, rotation can continue without further adjustment to the partitions. The user would merely be required to rotate his irrigation waters by opening and closing the desired gates on the gated pipe.

In some instances, where a large field is undergoing irrigation and the flow through the upstream containers are substantial, it is desirable to provide an alternate flow route for the water. This is accomplished with stop 26, illustrated in FIG. 2. By using a stop, an adjustable opening 25 is created below upwardly extending partition 16 which allows the flow of water beneath upwardly extending partition 16. Another advantage of this arrangement is that it minimizes air trapped by the flow of water over upwardly extension 16, which air may be carried into the downstream gated pipe.

Another feature of the preferred embodiment of the invention is air chamber 18 provided by downwardly extending partition 15. This chamber provides an escape route for air trapped in the pipe. The failure to provide such an escape route has been shown empirically to result in substantial flows of air into the downstream pipe and out at least the first encountered adjustable opening on the gated pipe. Tremendous amounts of air may be trapped in the water flowing over partition 16 and can result in uneven irrigation from the immediately downstream gate or gates if not allowed to escape from the pipe through air chamber 18.

An additional feature of preferred embodiment of the invention is the provision of an adjustable opening 27 on the side of the container. This opening is used like the openings in the gated pipe, to provide irrigation waters to the field. The addition of the containers to a gated pipe system can result in an area of the field which it is hard to route water to. Adjustable opening 27 may then be used to provide water over such gaps.

Presently gated pipe for irrigation use is readily available in diameters of 6", 8", 10", and 12". The larger diameter pipe of course is capable of substantially higher flows. Empirical tests have indicated that proper functioning of the invention can be achieved with containers that have a width of 12 inches for pipe having a diameter of 6 inches and 8 inches. Although such 12 inch width containers are usable with 10 inch diameter pipe, it is preferable that a the larger diameter pipe be used in conjunction with containers having a width of 14 to 16 inches. As gated pipe is used over a variety of field lengths and gradients, the actual width of the container is dependent on the flows desired for the particular situation. It has been empirically determined that it is desirable to keep the water depth flowing over the partitions below 3 inches and preferably in the range of 1 inch to 2 inches. The stop 26 illustrated in FIG. 2 can be utilized to provide an opening beneath the partition to aid in minimizing the height of water flowing over the upwardly extending partition. To the extent that excess water flows are encountered over the partition, it is necessary that a wider container be utilized. The height H of the container is preferably between 16 inches and 22 inches and the length may be between 14 inches and 20 inches depending on the pipe diameter concerned. It is of course desirable from a cost standpoint to minimize length although from a performance standpoint, larger values of length L are acceptable.

Referring to FIG. 2, the distance B which the downwardly extending partition 15 extends below the uppermost portion of outtake 13 is preferably between 1 inch and 2 inches. As long as excessive air is allowed to escape as evidenced by steady flows of water from the immediate downstream gate, further extensions of partition 15 into outtake 13 are not beneficial.

Referring to FIG. 3, the distances D and D' are best derived through trial and error on the specific field where the invention is to be used. A good starting point is between 8 inches and 12 inches and with minimum experimentation, appropriate distances and locations for the containers may be determined.

It has been found preferable to utilize the subject invention through irrigation over the complete system at once. For example, if rotation is such that every 7 sets the complete field is covered, it is preferable to open every 7th gate along the complete system, put the system into adjustment, and rotation can the be accomplished by merely walking down the system and closing each gate and opening the immediately adjacent gate.

What is claimed is:

1. In a gravity flow irrigation system, a method of providing a controlled flow of irrigation water from numerous openings in an extended length of above ground pipe over a gradient, comprising:

measuring the elevation drop over the length of said pipe;

providing an in-line container, open to atmospheric pressure, at predetermined elevation drops along said pipe, said container having an intake for receiving water from the upstream portion of said pipe and an outtake for discharging water to the downstream portion of said pipe;

dividing each of said containers with a height adjustable partition located between said intake and said outtake; and adjusting the height of each of said height adjustable partition to provide the desired flow from the openings in said extended length of pipe upstream of said partition being adjusted.

2. The method of claim 1 including the step of providing each of said containers with a downwardly extending partition between said height adjustable partition and said outtake, said downwardly extending partition extending from a point above the water being received to a point below the uppermost portion of said outtake.

3. The method of claim 2 including the step of providing each of said containers with an adjustable opening for flowing water to the exterior of said containers in a direction perpendicular to said extended length of pipe.

4. The method of claim 3 including the step of providing each of said height adjustable partitions with an opening adjacent the bottom of said containers to allow increased flow of water through said containers from said intake to said outtake.

5. In a gravity flow irrigation system, a method of providing a controlled flow of irrigation water from numerous openings in an extended length of above ground pipe over a gradient, comprising:

measuring the elevation drop over the length of said pipe;

providing an in-line container, open to atmospheric pressure, at predetermined elevation drops along said pipe, said container having an intake for receiving water from the upstream portion of said pipe and an outtake for discharging water to the downstream portion of said pipe;

dividing each of said containers with a height adjustable partition located between said intake and said outtake;

closing all openings in said extended length of above ground pipe except those openings through which irrigation water is desired;

introducing water from an open ditch system into said above ground pipe and through said pipe along said gradient;

allowing water to flow into the intake of the initial in-line container and, after building sufficient height, over the height adjustable partition of said initial container and through the outtake;

repeating the immediately foregoing step for each subsequent downstream container located at said predetermined elevation drops along said extended length of aboveground pipe;

adjusting the height of each of said height adjustable partitions to provide the desired flow from the openings in said extended length of pipe upstream of said partition being adjusted.

* * * * *